United States Patent [19]

Kumagai

[11] Patent Number: 4,948,556

[45] Date of Patent: Aug. 14, 1990

[54] PISTON RING MATERIAL AND PISTON RING

[75] Inventor: Atushi Kumagai, Yonago, Japan

[73] Assignee: Hitachi Metals, Ltd., Tokyo, Japan

[21] Appl. No.: 340,087

[22] Filed: Apr. 18, 1989

[30] Foreign Application Priority Data

Aug. 10, 1988 [JP] Japan ..... 63-199185

[51] Int. Cl.[5] ..... C22C 38/30

[52] U.S. Cl. ..... 420/36; 420/37; 148/318

[58] Field of Search ..... 420/36, 37, 38, 100, 420/102; 148/318, 326

[56] References Cited

U.S. PATENT DOCUMENTS

| | | | |
|---|---|---|---|
| 1,357,549 | 11/1920 | Fahrenwald | 420/36 |
| 3,554,735 | 1/1971 | Hiltebrand | 420/37 |

FOREIGN PATENT DOCUMENTS

| | | | |
|---|---|---|---|
| 2153488 | 8/1985 | European Pat. Off. | 148/318 |
| 50-102518 | 8/1975 | Japan | 420/37 |
| 56-98453 | 8/1981 | Japan . | |
| 58-45357 | 3/1983 | Japan . | |
| 58-181850 | 10/1983 | Japan | 420/37 |
| 58-197455 | 11/1983 | Japan . | |
| 61-22131 | 5/1986 | Japan . | |
| 241689 | 6/1978 | U.S.S.R. | 420/37 |

*Primary Examiner*—Deborah Yee

*Attorney, Agent, or Firm*—Antonelli, Terry, Stout & Kraus

[57] ABSTRACT

A piston ring material is capable of improving the heat resistance, abrasion resistance, nitriding characteristics and scuffing resistance that are required in a piston ring, the C content is 0.6 to 1.5%, and Co is contained in high Cr steel. The piston ring material consists by weight of 0.6 to 1.5% C, not more than 1.0% Si, not more than 1.0% Mn, 7.0 to 25.0% Cr, 2.0 to 13.0% Co, and the balance Fe and incidental impurities. In the piston ring material, a part of Fe can be replaced by at least one kind of Mo and W, and/or V, Nb, or Ni. A piston ring has a nitrided layer provided at least on a sliding surface thereof which slides against a cylinder wall.

10 Claims, 2 Drawing Sheets

PISTON RING MATERIAL AND PISTON RING

BACKGROUND OF THE INVENTION

The present invention relates to a material for a piston ring used to obtain developed power of an internal combustion engine such as an automobile engine by maintaining airtightness of the combustion chamber, and a piston ring which is produced from this material and the surface portion of which is nitrided.

Conventionally, a cast iron has been used for piston rings. However, as is particularly noticeable with automobile engines, piston rings have also come to be required to be light in weight in conjunction with the tendency for the engines to become light. On the other hand, the tendency for the engines to produce high developed power has made the working environments of the piston rings severe. Hence, a material which can bring about high performance with respect to various properties required and which is highly durable has been in demand as the material of the piston rings. Among conventional materials, one which takes abrasion resistance and heat resistance into account is disclosed in Japanese Patent Laid-Open Publication No. 52-27011. However, since this has premised a cast piston ring, it is difficult to make the piston ring light in weight by making its wall thickness small. In addition, since this material contains high contents of C and Si in view of castability and has a micro-structure of as cast state, it is difficult for the material to bring about such fatigue strength and toughness that are presently demanded. Under such background, a so-called steel ring has been thought of which is obtained by working a steel-made flat wire into an annular shape and has recently come to be used extensively. This steel ring has advantages in that it permits the wall thickness of the piston ring to be made samll, it satisfies the demand for light weight, and the production process can be made extremely simplified as compared with that for cast iron rings. Furthermore, by working a wire product, it is possible to produce piston rings having various characteristics by selecting a material from a wide class of conventional steels in compliance with required characteristics. Because of such background, the present applicant has put such steel piston ring materials into practical use that are disclosed in, for instance, Japanese Patent Examined Publication Nos. 61-22131, 57-8302, 58-46542, and 61-21302.

At present, Si-Cr steel (JIS SWOSC-V), and JIS SKD 61, 13Cr- and 17Cr-based martensitic stainless steels are used for those steel-made piston rings for automobile engine use in which a particularly severe working condition is required. These materials are used the hardness of which is kept to be in the range of HRC 38 to 45 because of the requirements of workability of the rings. Outer peripheral portion of the ring which slides against the cylinder is subjected to hard Cr plating, composite plating including hard particles, or nitriding in the case of a high Cr material so as to improve the abrasion resistance and scuffing resistance.

In the process of development of piston rings for use in automobile engines, for the purpose of attaining lightweight, the use of cast iron rings is shifting to that of steel rings which permit the wall thickness to be made small, and, as for the steel rings, the surface treatment provided on the sliding portions for reducing their sliding abrasion with respect to the cylinder is tending to shift from Cr plating to nitriding. In conjunction with these shifts, the ring material is also shifting toward a high Cr contained steel. A 17Cr contained martensitic stainless steel (JIS SUS440 B class) is available as the material capable of obtaining the highest performance.

Recently, however, the problem of the scuffingresisting property concerning scuffing between the cylinder and the ring has occurred due to the tendency to high-output performance resulting from diesel engines and the use of turbo chargers. Conventionally, the main characteristics required of piston rings were heat resistance and abrasion resistance. As high-developed power engines have become widespread, there arises a problem of the phenomenon of scuffing between the cylinder and the piston ring which scuffing occurs during the starting of the engine and abrupt rise in the engine speed. Hence, there has been demand for a material having a higher performance than that of the piston ring of the 17Cr contained martensitic stainless steel. Two methods of surface treatment are conceivable as countermeasures for improving the aforementioned phenomenon of scuffing. A first method is to effect plating of a composite material including dispersed hard particles or to effect flame-spraying of a metal or ceramics on the outer peripheral portion of the piston ring that slides against the cylinder. This method makes it possible to improve the scuffing-resisting property and abrasion resistance, but the abrasion of the inner surface of the cylinder is intense. Moreover, this method tends to result in the exfoliation of the surface-treated layer and the deterioration of the mechanical properties (particularly the fatigue strength) of the ring material. Therefore, a further research is needed with respect to this method. A second method is to effect a nitriding treatment which is a simple process and which is effective in improving the mechanical properties of the ring material. However, if the conventional steels are used, its effect of preventing scuffing is small and is unsatisfactory.

SUMMARY OF THE INVENTION

Accordingly, an object of the present invention is to provide a piston ring material which brings about outstanding nitriding characteristics for improving the scuffing-resisting property and to provide a piston ring made of said material, thereby improving the above-described drawbacks of the prior art.

To this end, a piston ring material (hereinafter referred to as the steel of the present invention) in accordance with the present invnetion has as its basic composition 0.6 to 1.5% C and high Cr, improves heat resistance and abrasion resistance required in a piston ring, and brings about outstanding properties when a nitriding treatment is applied thereto. Furthermore, with the addition of Co thereto, the scuffing resistance which is aimed at in this invention can be improved appreciably.

All of the piston ring materials of the present invention contain Co as an essential component, and in accordance with a first aspect of the invention, there is provided a piston ring material consisting by weight of 0.6 to 1.5% C, not more than 1.0% Si, not more than 1.0% Mn, 7.0 to 25.0% Cr, 2.0 to 13.0% Co, and the balance Fe and incidental impurities.

In accordance with a second aspect of the invention, there is provided a piston ring material consisting by weight of 0.6 to 1.5% C, not more than 1.0% Si, not more than 1.0% Mn, 7.0 to 25.0% Cr, 2.0 to 13.0% Co, at least one kind selected from the group consisting of not less than 0.2% but less than 1.0% Mo and not less than 0.4% but less than 2.0% W, and the balance Fe and incidental impurities, the total amount of the content of said Mo and half content of said W being not less than 0.2% but less than 1.0%.

In accordance with a third aspect of the invention, there is provided a piston ring material consisting by weight of 0.6 to 1.5% C, not more than 1.0% Si, not more than 1.0% Mn, more than 10% but not more than 25.0% Cr, 2.0 to 13.0% Co, and the balance Fe and incidental impurities.

In accordance with a fourth aspect of the invention, there is provided a piston ring material consisting by weight of 0.6 to 1.5% C, not more than 1.0% Si, not more than 1.0% Mn, more than 10% but not more than 25.0% Cr, 2.0 to 13.0% Co, at least one kind selected from the group consisting of 0.2 to 3.0% Mo and 0.4 to 6.0% W, and the balance Fe and incidental impurities, the total amount of the content of said Mo and half content of said W being 0.2 to 3.0%.

In accordance with a fifth aspect of the invention, there is provided a piston ring material according to any one of the second to fourth aspects of the invention, wherein a part of Fe is replaced by at least one kind selected from the group consisting of 0.05 to 3.0% V and 0.05 to 3.0% Nb, the total amount of the content of said V and content of said Nb being 0.05 to 3.0%.

In accordance with a sixth aspect of the invention, there is provided a piston ring material according to any one of the first to fifth aspects of the invention, wherein a part of Fe is replaced by 0.3 to 2.0% Ni.

In accordance with a seven aspect of the invention there is provided a piston ring having a composition according to any one of the first to sixth aspects of the invention, comprising a nitrided layer provided at least on a sliding surface thereof which slides against a cylinder wall.

Among the above-described aspects of the invention, the piston ring material of the second aspect of the invention is one in which a part of Fe of the first aspect of the invention is replaced by at least one kind selected from the group consisting of not less than 0.2% but less than 1.0% Mo and not less than 0.4% but less than 2.0% W, the total amount of the content of said Mo and half content of said W being not less than 0.2% but less than 1.0%. The piston ring material of the third invention is one in which the content of Cr in the composition of the first aspect of the invention is made to be more than 10% but not more than 25.0%. The piston ring material of the forth aspect of the invention is one in which a part of Fe of the third aspect of the invention is replaced by at least one kind selected from the group consisting of 0.2 to 3.0% Mo and 0.4 to 6.0% W, the total amount of the content of said Mo and half content of said W being 0.2 to 3.0%.

The reasons for restricting the components of the steel of the present invention will be described below.

Since carbon is combined with carbide-forming elements such as Cr, Mo, W, V and Nb, carbon contributes to abrasion resistance and scuffing resistance that are necessary as the properties of a piston ring, and a part of this carbon is in a solid solution state in a matrix to thereby strengthen the matrix. If its content is less than 0.6%, hardness of the annealed steel of the invention decreases excessively, while if it exceeds 1.5%, the workability thereof during ring formation is not only deteriorated but also its mechanical properties, fatigue strength in particular, are deteriorated. Thus, the carbon content is set to 0.6–1.5%. In particular, a preferable range in view of workability is 0.6–1.2%.

Both Si and Mn are added mainly as a deoxidizing agent and desulphurizing agent, respectively, during refining, and if their contents exceed 1%, Si and Mn become detrimental elements regarding cold workability and hot workability, respectively. Thus, their upper limits were set to 1.0%, respectively.

As described above, chromium forms Cr carbides ($M_{23}C_6$ and $M_7C_3$ type carbides) and is an essential element in improving abrasion resistance. A part of chromium is in a solid-solution state in a matrix to thereby contribute to its improved resistance against oxidation and thermal resistance. In addition, by effecting a nitriding treatment, it contributes to generate a hard nitrided layer to thereby further improve abrasion resistance. If the Cr content is less than 7.0%, the aforementioned effects are small. On the other hand, if the Cr content exceeds 25.0%, not only an excessive amount of eutectic carbides is formed, but also a stable ferrite phase occurs which remains as a soft phase even by being subjected to both quenching and tempering, so that the strength thereof decreases. Thus, the Cr content is set to 7.0–25.0%. In order to further improve abrasion resistance, the Cr content may be in an upper range thereof, but a preferable range of the Cr content for obtaining an appropriate amount of eutectic carbides is more than 10% but not more than 22%.

Co is the most important element in improving the scuffing-resisting property in the present invention. Co does not form carbides, and is in a solid solution state in a matrix to thereby enhance heat resistance of the matrix and suppressing the occurrence of the ferrite phase which is a soft phase. Furthermore, as will be shown in Examples, the effect of Co was clearly recognized regarding the scuffing-resisting property. In order to ensure the effect fully, at least not less than 2% of Co is necessary. If the Co content exceeds 13%, hot workability and cold workability (elongation and reduction) are deteriorated, so that the Co content is set to 2.0–13.0%.

Mo and W contribute to the formation of a hard nitrided layer and they themselves form hard carbides, and a part of each of them is in a solid-solution state in Cr carbides of the $M_7C_3$ and $M_{23}C_6$ type to thereby strengthen the carbides. If the Mo content is less than 0.2% and if the W content is less than 0.4%, the effect of their addition is small, while toughness is deteriorated if the contents thereof exceed 3.0% and 6.0%, respectively. Accordingly, the Mo content is set to 0.2–3.0%, and the W content to 0.4–6.0%. However, since the effect of the Mo content is equivalent to the effect of the half content of W, the total contents of the Mo contents and the half of the W contents are set to 0.2–3.0%. Preferably, the Mo content is not less than 0.2% but less than 1.0%, while the W content is not less than 0.4% but less than 2.0% (however, their total contents in terms of said Mo content and the half content of said W are not less than 0.2% but less than 1.0%).

Both elements of V and Nb contribute to make crystal particles very fine and to the improving of toughness. In addition, these elements themselves form hard MC-type carbides in the same way as Mo and W, and produces a great effect on abrasion resistance. Furthermore, a part of W and Nb forms a solid solution with Cr carbides to thereby strengthen the carbide. If the V and Nb contents are less than 0.05%, their effect on the aforementioned action is small, while if their contents exceed 3.0%, an excessive amount of MC-type carbides are formed, so that each of their ranges is set to 0.05–3.0%. However, the effect of V is equivalent to that of Nb, and it is essential that the contents of V plus Nb are in the range of 0.05–3.0%.

Ni does not form any carbides, and are in a solid-solution state in the matrix to thereby contribute to improve mechanical properties, toughness in particular. In addition, since Ni improves workability expressed by elongation and reduction, this element is advantageous in the formability of the piston ring. For this reason, the Ni content is required to be not less than 0.3%, but if it exceeds 2.0%, it becomes difficult to obtain a predetermined hardness by a heat treatment. Consequently, the Ni content is set to 0.3–2.0%.

Another feature of the present invention is that a piston ring having the above-described composition has very outstanding nitriding characteristics. A piston ring made of the steel of the present invention containing a large amount of Cr to which steel a nitriding treatment is applied is provided with a hard nitrided layer, thereby remarkably improving the scuffing-resisting property and abrasion resistance of the sliding surface.

DESCRIPTION OF THE PREFERRED EMBODIMENTS

Figure 1:
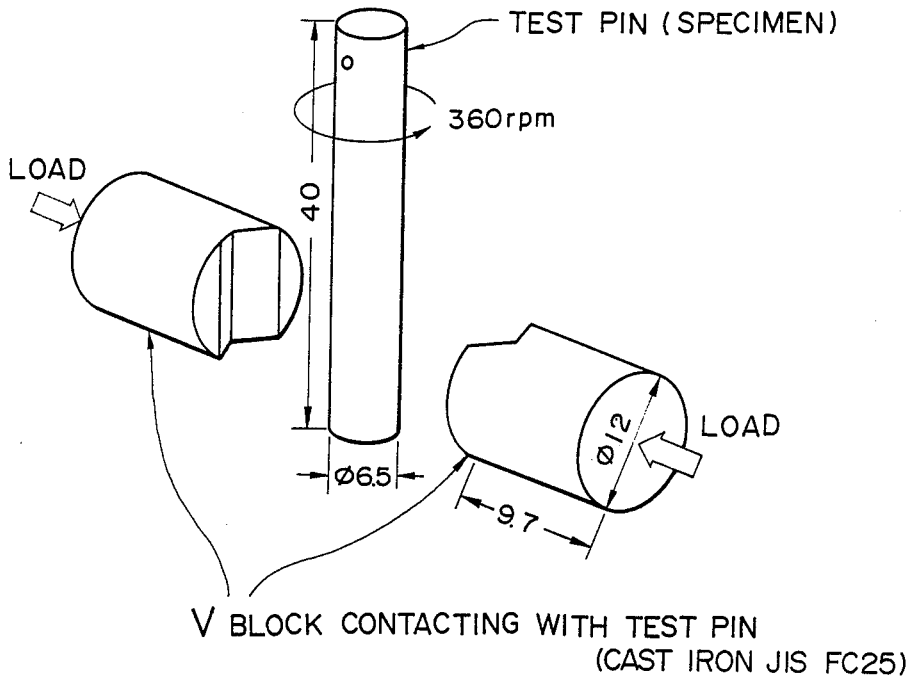
FIG. 1 is a perspective view illustrating a scuffing test used in the invention.

The scuffing load was measured by using specimens shown in Table 1 so as to determine the effect of the scuff-resisting property brought about by the addition of Co while keeping the C and Cr contents in the same levels. The measurement of scuffing load was conducted by using a Fabry-Perét abrasion testing machine, a test state of which machine is shown in FIG. 1. This testing machine is arranged such that a specimen rotating at 300 rpm is clamped by a pair of V-block which is the counterpart material while a load is being gradually applied to it, and seizure is sensed by variations in torque of a test pin, and the load at that time is measured. In this test, FC 25 which is an cylinder material for the engine was used as the counterpart material, and a wet-type test was adopted in which lubricating oil was allowed to drop during the test. In addition, the load was applied at a rate of 8 kgf/sec. It had been confirmed from past experience that this testing method is capable of faithfully simulating the degree of scuffing in a test using actual piston ring. The testpieces were mechanically worked roughly into a shape of the test pieces, were modified into HRC 40 by means of quenching and tempering, and were then finally finished. Subsequently, the testpieces were subjected to gas nitriding treatment at 540° C. for 20 hours. Since brittle nitrides are formed on the outermost surface of the nitrogen-diffused layer due to gas nitriding treatment, the nitrides were removed by grinding and were used as testpieces. In the chemical compositions shown in Table 1, the hardness of the nitrided layers were substantially similar in value in the range of HV 1100–1200, and the micro structures, i.e., the configuration and amount of distribution of primary and secondary carbides were in the same state. Accordingly, since Co is in a solid-solution state in the matrix, it is possible to clarify the effect of the amount of addition thereof on the scuffing-resisting property.

Figure 2:
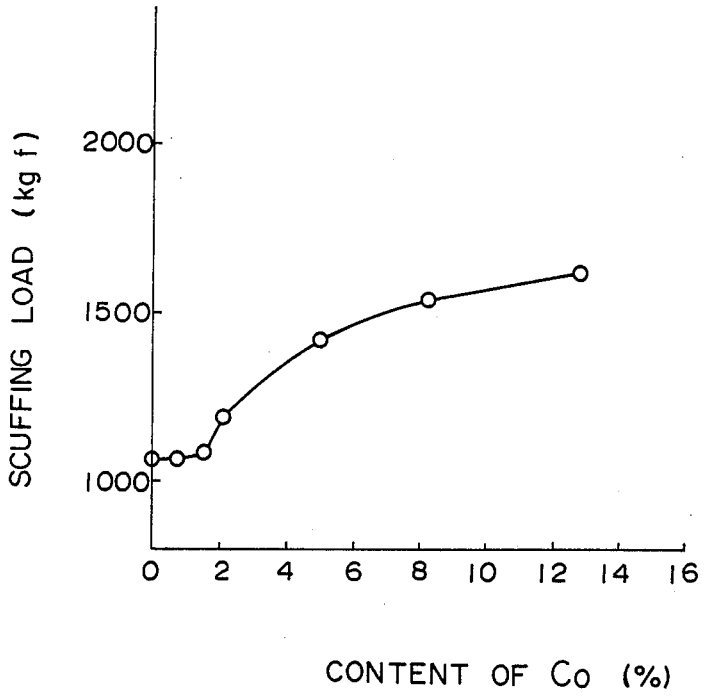
FIG. 2 is a graph showing a relationship between the addition contents of Co and the scuffing load.

FIG. 2 shows the test results. It can be seen from this graph that the scuffing load increased with the addition of Co set at approximately 2%, that this tendency continued with further addition thereof, and that this effect can be obtained up to 13% or thereabouts.

TABLE 1

| | Chemical Composition of Specimens (wt %) | | | | | |
|---|---|---|---|---|---|---|
| No. | C | Si | Mn | Cr | Co | Remarks |
| 1 | 0.87 | 0.45 | 0.43 | 16.92 | — | Comparative steel |
| 2 | 0.85 | 0.39 | 0.41 | 17.21 | 0.82 | Comparative steel |
| 3 | 0.85 | 0.38 | 0.42 | 17.15 | 1.62 | Comparative steel |
| 4 | 0.84 | 0.46 | 0.45 | 17.32 | 2.10 | Steel of This Invention |
| 5 | 0.87 | 0.44 | 0.43 | 17.05 | 5.10 | Steel of This Invention |
| 6 | 0.82 | 0.41 | 0.46 | 17.42 | 8.29 | Steel of This Invention |
| 7 | 0.85 | 0.39 | 0.42 | 17.21 | 12.83 | Steel of This Invention |

TABLE 2

| | Chemical Composition of Specimen (wt %) | | | | | | | | | | |
|---|---|---|---|---|---|---|---|---|---|---|---|
| No. | C | Si | Mn | Ni | Cr | Mo | W | V | Nb | Co | Remarks |
| 8 | 1.21 | 0.32 | 0.42 | — | 7.12 | — | — | — | — | 7.08 | Steel of This Invention |
| 9 | 1.13 | 0.41 | 0.35 | — | 8.45 | — | — | — | — | 3.23 | Steel of This Invention |
| 10 | 1.14 | 0.45 | 0.32 | — | 8.50 | — | — | — | — | 11.77 | Steel of This Invention |
| 11 | 1.32 | 0.47 | 0.33 | — | 9.59 | — | — | — | — | 7.54 | Steel of This Invention |
| 12 | 1.32 | 0.62 | 0.45 | — | 8.48 | 0.78 | — | — | — | 3.86 | Steel of This Invention |
| 13 | 1.12 | 0.65 | 0.55 | — | 8.62 | — | 1.25 | — | — | 3.94 | Steel of This Invention |
| 14 | 1.05 | 0.44 | 0.62 | — | 8.39 | 0.31 | 1.07 | — | — | 7.95 | Steel of This Invention |
| 15 | 0.82 | 0.41 | 0.63 | — | 17.20 | 0.62 | — | — | — | 4.01 | Steel of |

TABLE 2-continued

| No. | C | Si | Mn | Ni | Cr | Mo | W | V | Nb | Co | Remarks |
|---|---|---|---|---|---|---|---|---|---|---|---|
| | | | Chemical Composition of Specimen (wt %) | | | | | | | | |
| | | | | | | | | | | | This Invention |
| 16 | 0.62 | 0.62 | 0.41 | — | 21.25 | — | — | — | — | 4.51 | Steel of This Invention |
| 17 | 0.71 | 0.53 | 0.42 | — | 18.53 | — | — | — | — | 3.21 | Steel of This Invention |
| 18 | 0.88 | 0.41 | 0.35 | — | 13.42 | — | — | — | — | 8.59 | Steel of This Invention |
| 19 | 1.02 | 0.51 | 0.43 | — | 15.62 | — | — | — | — | 5.11 | Steel of This Invention |
| 20 | 0.85 | 0.53 | 0.45 | — | 20.50 | — | — | — | — | 5.52 | Steel of This Invention |
| 21 | 1.03 | 0.51 | 0.42 | — | 11.74 | 2.41 | — | — | — | 8.21 | Steel of This Invention |
| 22 | 0.79 | 0.40 | 0.39 | — | 16.91 | — | 5.22 | — | — | 3.88 | Steel of This Invention |
| 23 | 0.85 | 0.43 | 0.45 | — | 18.03 | 1.77 | 0.56 | — | — | 8.74 | Steel of This Invention |
| 24 | 0.79 | 0.41 | 0.38 | — | 13.12 | 1.82 | 2.13 | — | — | 7.92 | Steel of This Invention |
| 25 | 1.42 | 0.35 | 0.72 | — | 21.50 | 2.05 | 1.00 | — | — | 3.56 | Steel of This Invention |
| 26 | 0.83 | 0.45 | 0.37 | — | 17.22 | — | — | 0.11 | — | 8.30 | Steel of This Invention |
| 27 | 1.13 | 0.67 | 0.35 | — | 8.51 | 0.75 | — | 1.46 | 0.31 | 3.56 | Steel of This Invention |
| 28 | 0.92 | 0.71 | 0.45 | — | 17.27 | 0.56 | — | 2.30 | — | 5.24 | Steel of This Invention |
| 29 | 0.87 | 0.77 | 0.47 | — | 17.19 | 0.64 | 0.32 | 0.12 | — | 3.98 | Steel of This Invention |
| 30 | 0.81 | 0.65 | 0.48 | — | 17.52 | 0.69 | 0.20 | 1.11 | — | 8.01 | Steel of This Invention |
| 31 | 0.85 | 0.45 | 0.42 | — | 17.55 | — | — | 0.83 | — | 8.04 | Steel of This Invention |
| 32 | 0.67 | 0.42 | 0.49 | — | 12.20 | 0.51 | 0.33 | 1.06 | 0.32 | 3.80 | Steel of This Invention |
| 33 | 0.89 | 0.44 | 0.52 | — | 16.97 | 0.83 | — | 0.78 | — | 3.91 | Steel of This Invention |
| 34 | 0.89 | 0.53 | 0.50 | — | 17.44 | 0.65 | — | 1.16 | — | 8.04 | Steel of This Invention |
| 35 | 0.93 | 0.57 | 0.51 | — | 17.38 | 1.13 | — | 1.07 | — | 4.02 | Steel of This Invention |
| 36 | 0.95 | 0.41 | 0.55 | — | 17.41 | 1.23 | — | 1.11 | — | 7.88 | Steel of This Invention |
| 37 | 1.05 | 0.62 | 0.44 | — | 17.13 | 1.02 | 1.62 | 0.10 | 0.05 | 2.56 | Steel of This Invention |
| 38 | 0.82 | 0.42 | 0.33 | — | 17.51 | 1.05 | — | 0.08 | — | 8.20 | Steel of This Invention |
| 39 | 0.97 | 0.35 | 0.42 | — | 17.36 | 0.52 | 0.45 | 2.01 | 0.23 | 10.78 | Steel of This Invention |
| 40 | 0.70 | 0.48 | 0.40 | 1.19 | 18.14 | — | — | — | — | 3.81 | Steel of This Invention |
| 41 | 0.75 | 0.44 | 0.41 | 0.87 | 19.01 | — | 0.63 | — | — | 8.09 | Steel of This Invention |

TABLE 2-continued

| No. | C | Si | Mn | Ni | Cr | Mo | W | V | Nb | Co | Remarks |
|---|---|---|---|---|---|---|---|---|---|---|---|
| | Chemical Composition of Specimen (wt %) | | | | | | | | | | |
| 42 | 0.80 | 0.45 | 0.44 | 0.55 | 17.03 | — | — | 0.11 | — | 7.99 | Steel of This Invention |
| 43 | 0.71 | 0.71 | 0.39 | 0.81 | 14.25 | 0.81 | — | 1.13 | 1.56 | 4.21 | Steel of This Invention |
| 44 | 0.89 | 0.63 | 0.42 | 1.21 | 16.92 | 0.51 | 2.00 | 1.20 | — | 8.11 | Steel of This Invention |
| 45 | 1.13 | 0.41 | 0.78 | 0.75 | 23.20 | 0.81 | 0.92 | 1.50 | 0.32 | 5.21 | Steel of This Invention |
| 46 | 1.33 | 0.32 | 0.81 | 1.21 | 24.80 | 1.53 | 0.54 | 0.81 | 0.92 | 11.52 | Steel of This Invention |
| 47 | 0.87 | 0.47 | 0.43 | — | 17.12 | 1.20 | — | 0.30 | — | — | Conventional steel |

Next, there are shown the results of conducting a similar Fabry-Perét abrasion test on the steels of the present invention and on the conventional steel. Table 2 shows the chemical components of testpieces. As the conventional steel, 17Cr-contained martensitic stainless steel which is the most outstanding material as a steel ring currently used after being nitrided was used as a comparative material. The test results, together with the hardness of the nitrided layer, are shown in Table 3. The hardness of the nitrided layer was substantially proportional to the Cr content, but, when Mo and V were added, it was possible to obtain a high nitrided-layer hardness even in a case of relatively low Cr. The scuffing load showed a value which was 1.4 to 2 times that of the conventional steel, and, as for abrasion resistance, the amount of abrasion decreased by 10–70% as compared with the conventional steel. Thus, it can be appreciated that the steels of the present invention remarkably improved scuffing resistance and abrasion resistance, as compared with the conventional steel.

TABLE 3

| No. | Nitriding layer hardness (HV) | Results of Scuffing Test: Scuffing Load (kgf) | Abrasion Resistance* | Remarks |
|---|---|---|---|---|
| 8 | 980 | 1215 | 79 | Steel of this invention |
| 9 | 995 | 1195 | 81 | Steel of this invention |
| 10 | 980 | 1380 | 85 | Steel of this invention |
| 11 | 1005 | 1320 | 68 | Steel of this invention |
| 12 | 975 | 1230 | 72 | Steel of this invention |
| 13 | 982 | 1310 | 78 | Steel of this invention |
| 14 | 993 | 1410 | 75 | Steel of this invention |
| 15 | 1083 | 1590 | 63 | Steel of this invention |
| 16 | 1185 | 1880 | 54 | Steel of this invention |
| 17 | 1152 | 1520 | 85 | Steel of this invention |
| 18 | 1005 | 1385 | 82 | Steel of this invention |
| 19 | 1082 | 1430 | 71 | Steel of this invention |
| 20 | 1170 | 1710 | 52 | Steel of this invention |
| 21 | 1020 | 1425 | 83 | Steel of this invention |
| 22 | 1125 | 1505 | 81 | Steel of this invention |
| 23 | 1190 | 1820 | 80 | Steel of this invention |
| 24 | 1055 | 1410 | 89 | Steel of this invention |
| 25 | 1192 | 1830 | 31 | Steel of this invention |
| 26 | 1088 | 1507 | 77 | Steel of this invention |
| 27 | 982 | 1215 | 80 | Steel of this invention |
| 28 | 1150 | 1510 | 62 | Steel of this invention |
| 29 | 1210 | 1425 | 88 | Steel of this invention |
| 30 | 1185 | 1580 | 85 | Steel of this invention |
| 31 | 1170 | 1575 | 81 | Steel of this invention |
| 32 | 1051 | 1310 | 71 | Steel of this invention |
| 33 | 1155 | 1420 | 83 | Steel of this invention |
| 34 | 1172 | 1580 | 80 | Steel of this invention |

TABLE 3-continued

| No. | Nitriding layer hardness (HV) | Results of Scuffing Test: Scuffing Load (kgf) | Abrasion Resistance* | Remarks |
|---|---|---|---|---|
| 35 | 1180 | 1350 | 75 | Steel of this invention |
| 36 | 1195 | 1570 | 78 | Steel of this invention |
| 37 | 1093 | 1495 | 85 | Steel of this invention |
| 38 | 1185 | 1480 | 88 | Steel of this invention |
| 39 | 1215 | 1720 | 58 | Steel of this invention |
| 40 | 1129 | 1561 | 86 | Steel of this invention |
| 41 | 1130 | 1557 | 66 | Steel of this invention |
| 42 | 1106 | 1555 | 64 | Steel of this invention |
| 43 | 1073 | 1520 | 58 | Steel of this invention |
| 44 | 1120 | 1655 | 57 | Steel of this invention |
| 45 | 1233 | 2050 | 42 | Steel of this invention |
| 46 | 1285 | 2210 | 37 | Steel of this invention |
| 47 | 1020 | 1040 | 100 | Conventional steel |

*These values are indexes in a case where the amount of abrasion of the conventional steel No. 47 is set as 100.

As described above, in accordance with the present invention, there is provided a material superior in scuffing resistance and abrasion resistance for use as a piston ring for an internal combustion engine. The material of the piston rings is shifting from cast iron to steel, and in correspondence with required characteristics, a wide variety of nitrided materials and Cr plated materials are available. In the present situation, however, nitrided materials are most advantageous in terms of the overall performance including the manufacturing conditions. The present invention has premised nitriding, and aims at improving the scuffing resistance which is particularly required in automobile engines in recent years, and the present invention made large contributions to the high-performance of engines.

What is claimed is:

1. A piston ring material consisting by weight of 0.6 to 1.5% C, not more than 1.0% Si, not more than 1.0% Mn, 7.0 to 25.0% Cr, 2.0 to 13.0% Co, 0.05 to 3.0% V, 0.05 to 3.0% Nb, and the balance Fe and incidental impurities, the total amount of said V and Nb being 0.05 to 3.0%.

2. A piston ring material consisting by weight of 0.6 to 1.5% C, not more than 1.0% Si, not more than 1.0% Mn, 0.3 to 2.0% Ni, 7.0 to 25.0% Cr, 2.0 to 13.0% Co, 0.05 to 3.0% V, 0.05 to 3.0% Nb, and the balance Fe and incidental impurities, the total amount of said V and Nb being 0.05 to 3.0%.

3. A piston ring material consisting by weight of 0.6 to 1.5% C, not more than 1.0% Si, not more than 1.0% Mn, more than 10% but not more than 25.0% Cr, 2.0 to 13.0% Co, 0.05 to 3.0% V, 0.05 to 3.0% Nb, and the balance Fe and incidental impurities, the total amount of said V and Nb being 0.05 to 3.0%.

4. A piston ring material consisting by weight of 0.6 to 1.5% C, not more than 1.0% Si, not more than 1.0% Mn, 0.3 to 2.0% Ni, more than 10% but not more than 25.0% Cr, 2.0 to 13.0% Co, 0.05 to 3.0% V, 0.05 to 3.0% Nb, and the balance Fe and incidental impurities, the total amount of said V and Nb being 0.05 to 3.0%.

5. A piston ring having a composition consisting essentially of by weight of 0.6 to 1.5% C, not more than 1.0% Si, not more than 1.0% Mn, 7.0 to 25.0% Cr, 2.0 to 13.0% Co, and the balance Fe and incidental impurities, said piston ring comprising a nitrided layer provided at least on a sliding surface thereof which is slidable against a cylinder wall.

6. A piston ring having a composition consisting essentially of by weight of 0.6 to 1.5% C, not more than 1.0% Si, not more than 1.0% Mn, 7.0 to 25.0% Cr, 2.0 to 13.0% Co, at least one kind selected from the group consisting of not less than 0.2% but less than 1.0% Mo and not less than 0.4% but less than 2.0% W, and the balance Fe and incidental impurities, the total amount of the content of said Mo and half content of said W being not less than 0.2% but less than 1.0%, said piston ring comprising a nitrided layer provided at least on a sliding surface thereof which is slidable against a cylinder wall.

7. A piston ring having a composition consisting essentially of by weight of 0.6 to 1.5% C, not more than 1.0% Si, not more than 1.0% Mn, more than 10% but not more than 25.0% Cr, 2.0 to 13.0% Co, and the balance Fe and incidental impurities, said piston ring comprising a nitrided layer provided at least on a sliding surface thereof which is slidable against a cylinder wall.

8. A piston ring having a composition consisting essentially of by weight of 0.6 to 1.5% C, not more than 1.0% Si, not more than 1.0% Mn, more than 10% but not more than 25.0% Cr, 2.0 to 13.0% Co, at least one kind selected from the group consisting of 0.2 to 3.0% Mo and 0.4 to 6.0% W, and the balance Fe and incidental impurities, the total amount of the content of said Mo and half content of said W being 0.2 to 3.0%, said piston ring comprising a nitrided layer provided at least on a sliding surface thereof which is slidable against a cylinder wall.

9. A piston ring according to any one of claims 5 to 8, wherein a part of Fe is replaced by at least one kind selected from the group consisting of 0.05 to 3.0% V and 0.05 to 3.0% Nb, the total amount of the content of said V and content of said Nb being 0.05 to 3.0%, said piston ring comprising a nitrided layer provided at least on a sliding surface thereof which is slidable against a cylinder wall.

10. A piston ring according to any one of claims 5 to 8, wherein a part of Fe is replaced by 0.3 to 2.0% Ni, said piston ring comprising a nitrided layer provided at least on a sliding surface thereof which is slidable against a cylinder wall.

* * * * *